United States Patent [19]

Robinson, Jr.

[11] 4,330,309

[45] May 18, 1982

[54] HEAT PUMP WATER HEATER

[76] Inventor: Glen P. Robinson, Jr., 1050 Mt. Paran Rd. NW., Atlanta, Ga. 30327

[21] Appl. No.: 180,702

[22] Filed: Aug. 25, 1980

Related U.S. Application Data

[63] Continuation of Ser. No. 49,430, Jun. 18, 1979.

[51] Int. Cl.[3] ..... F25D 17/00; G05D 23/00

[52] U.S. Cl. ..... 62/181; 62/238.6; 237/2 B

[58] Field of Search ..... 62/238.6, 324.5, 184, 62/181; 237/2 B

[56] References Cited

U.S. PATENT DOCUMENTS

| | | | |
|---|---|---|---|
| 2,575,325 | 11/1951 | Ambrose et al. | 62/238 E |
| 2,668,420 | 2/1954 | Hammell | 62/238 E |
| 3,922,876 | 12/1975 | Wetherington, Jr. et al. | 62/238 EX |
| 4,073,285 | 2/1978 | Wendel | 62/238.6 |
| 4,136,731 | 1/1979 | DeBoer | 165/12 |
| 4,141,222 | 2/1979 | Ritchie | 62/238 E |
| 4,142,379 | 3/1979 | Kuklinski | 62/238.6 |

OTHER PUBLICATIONS

Powell, Evan, Heat Pump Water Heater, *Popular Science,* Apr. 1980, pp. 49–50.

*Primary Examiner*—Albert J. Makay
*Assistant Examiner*—Harry Tanner
*Attorney, Agent, or Firm*—B. J. Powell

[57] ABSTRACT

A water heater construction and the method of operation thereof including a water tank containing water to be heated; a heat pump having condenser heat exchanger externally of the water tank; circulation means for circulating water from the lower end of the water tank through the condenser heat exchanger to heat the water and then back into the upper end of the water tank; and control means for controlling the circulation of the water by the circulation means so that the water returning to the water tank from the condenser heat exchanger has been heated to at least a predetermined return water temperature by the condenser heat exchanger sufficient for immediate use. The control means may include variable flow control valve operatively connecting the condenser heat exchanger with the upper end of the water tank with the flow control valve regulating the flow of water so that the temperature of the water leaving the condenser heat exchanger for return to the upper end of the water tank is at least at the predetermined return water temperature.

10 Claims, 1 Drawing Figure

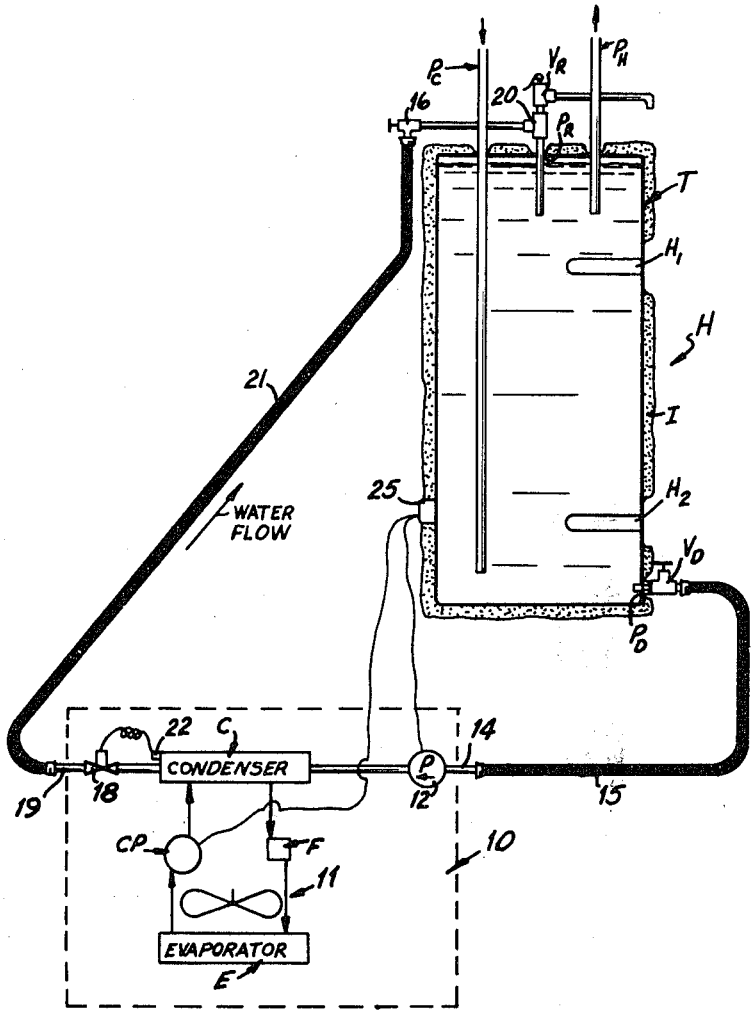
$P_C$
$V_R$
$P_H$
16
20
$P_R$
T
$H_1$
H
21
I
25
$H_2$
WATER FLOW
$V_O$
$P_O$
22
C
14
CONDENSER
19
18
12
15
CP
F
10
11
EVAPORATOR
E

HEAT PUMP WATER HEATER

CROSS REFERENCE TO THE RELATED APPLICATION

This application is a continuation of my co-pending application Ser. No. 049,430, filed June 18, 1979.

BACKGROUND OF THE INVENTION

This invention relates generally to heating devices for water heaters; and more particularly to a heat pump used to heat the water in a water heater.

Heat pumps have been used before to heat water for water heater installations. Examples of these uses are illustrated by U.S. Pat. Nos. 2,125,842 and 4,091,994. U.S. Pat. No. 2,125,842 discloses the submersion of the heat pump condenser coil directly in the water in the heater water tank as well as positioning of the condenser heat exchanger externally of the heater water tank and circulating the water through the condenser by withdrawing it from the lower end of the tank and returning it to the upper end of the tank. U.S. Pat. No. 4,091,994 discloses positioning the condenser coil around the outside of the heater water receptacle so that the condenser transfers heat to water in the tank through the tank wall itself.

These prior art water heater heat pumps have not found widespread use even though they are markedly more energy-efficient than typical electrical resistance heated water heaters. This is due to the fact that hot water recovery rate of such devices is generally unacceptably low and that these devices generally required the purchase of both the water tank and the heat pump mechanism thereby not affording the user the opportunity to keep an existing water heater.

SUMMARY OF THE INVENTION

These and other problems and disadvantages associated with the prior art are overcome by the invention disclosed herein by providing a heat pump for heating the water in a water heater which has a high hot water recovery rate and which may be used in conjunction with an existing water heater to heat the water therein. Thus, not only is the more energy-efficient operation of the heat pump device capable of being used, the hot water recovery rate is greatly improved over that associated with the prior art.

The apparatus of the invention includes generally a water tank which contains the water to be heated with the water in the lower level of the tank circulated through the condenser heat exchanger in a heat pump located externally of the water tank by circulation means such as a pump so that water from the bottom of the water tank can be circulated through the condenser heat exchanger to heat the water and then back into the top of the water tank. Temperature control means is provided for maintaining the water in the condenser heat exchanger until the water in the condenser heat exchanger reaches a predetermined return temperature so that the water returned to the top of the water tank is at least at the predetermined temperature. The predetermined temperature is selected to be hot enough for immediate use by the user. Because the water in the water tank naturally stratifies with the hotter water being at the top, the hot water being returned from the condenser heat exchanger in the heat pump can be immediately used by the user of the invention. The temperature control means may be a variable flow control valve which regulates the water flow rate from the condenser heat exchanger back to the water tank in response to the temperature of the water leaving the condenser heat exchanger so that the leaving water temperature is always above the pre-determined return water temperature.

The water tank used with the heat pump device may be an existing water heater with the heat pump used to heat the water in lieu of the conventional heating device supplied with the water heater. The circulation means may be used to connect the condenser heat exchanger on the heat pump device with existing connections on the hot water heater without interfering with the water connections already attached to the water heater.

The method of the invention includes the steps of circulating the water in the water tank from the bottom of the tank to the top of the tank through a heat pump condenser heat exchanger so that the water circulating through the heat pump condenser heat exchanger is heated and maintaining the water being circulated in the condenser heat exchanger until it reaches a predetermined temperature so that the water returned to the top of the water tank is at least at the predetermined temperature in order for the user to be able to use this water as soon as it is returned to the tank.

These and other features and advantages of the invention will become more clearly understood upon consideration of the following specification and accompanying drawing wherein:

BRIEF DESCRIPTION OF THE DRAWING

The drawing schematically illustrates the invention utilizing an existing hot water heater.

This FIGURE and the following detailed description discloses specific embodiments of the invention; however, the inventive concept is not limited thereto since it may be embodied in other forms.

DETAILED DESCRIPTION OF ILLUSTRATIVE EMBODIMENTS

The drawing schematically illustrates the invention utilizing an existing water heater H with electrical resistance upper and lower heating elements $H_1$ and $H_2$ respectively. These elements are not used with the invention. The water heater H, being of conventional construction, has a cold water supply pipe $P_C$ which empties adjacent the lower end of the generally vertically oriented tank T. The heater H also has a hot water supply pipe $P_H$ which removes water for use from the upper end of tank T. Because water in an upright tank naturally stratifies according to temperature with the hotter temperature being at the upper end, the hottest temperature water in the tank is withdrawn through the pipe $P_H$. The tank T is provided with an appropriate opening $P_R$ adjacent its upper end for connection to a pressure and temperature relief valve $V_R$ and is also provided with an appropriate opening $P_D$ adjacent its bottom for connection of a drain valve $V_D$. The relief valve $V_R$ is provided to prevent damage to the tank if the pressure and temperature exceed a preset level while the drain valve $V_D$ is provided to afford draining the tank for service. Normally, the tank T is provided with appropriate insulation I. Because of the pre-existing openings $P_R$ and $P_D$ for the relief valve $V_R$ and the drain valve $V_D$, these openings can be used as connections to the tank T so that water can be withdrawn from the lower end of the tank T through the drain valve $V_D$ and returned to the tank T by the opening for the relief valve $V_R$.

The heating unit 10 illustrated in the drawings includes a heat pump 11 and a water circulation pump 12. The heat pump 11 has the basic components associated with a conventional heat pump of a condenser heat exchanger C, an evaporator heat exchanger E, a compressor CP and a liquid flow control valve F with the refrigerant in the heat pump being circulated by the compressor CP through the condenser heat exchanger C where the refrigerant gives up its heat, then through the refrigerant flow control device F to the evaporator heat exchanger E where the refrigerant is heated, and finally back to the compressor CP. The evaporator heat exchanger E may be of any number of types and is illustrated as a refrigerant to air type because air as a heat input medium is generally available in the vicinity of a typical water heater installation. The condenser heat exchanger C is of the refrigerant to liquid transfer type so that the water may be circulated therethrough in order for the water to be heated thereby.

The intake pipe 14 to pump 12 is removably connected to the drain valve $V_D$ on the water heater H via an appropriate hose 15 equipped with a fitting adapted to be screwed onto the drain valve and the drain valve $V_D$ is opened so that the water to pump 12 is withdrawn from the lower end of tank T. This also allows the drain valve to be closed so that the hose 15 can be removed. The outlet of pump 12 is connected to the water inlet on condenser heat exchanger C. As the pump 12 circulates the water through condenser heat exchanger C, the refrigerant in the heat pump 11 heats it. The water outlet from the condenser heat exchanger C is connected to a control valve 18 with its outlet pipe 19 connected to the relief port $P_R$ in the upper end of tank T through a connector 20 in port $P_R$ and hose 21. The connector 20 still maintains the relief valve $V_R$ in operative connection with the water in the upper end of tank T. A cutoff valve 16 may be used at connector 20 for hose 21 with the fitting on the hose adapted to be removably screwed onto cutoff valve 16. This also allows the valve 16 to be closed so that hose 21 can be removed.

The control valve 18 is constructed so that the water returning to the tank T from the condenser heat exchanger C is at least at a predetermined temperature sufficiently high for use of this water by the user. Usually, the valve 18 does not open until the temperature of the water in the condenser heat exchanger C reaches a predetermined temperature. Valve 18 is equipped with an appropriate sensor 22 responsive to the temperature of the water in the condenser heat exchanger C to cause it to operate. Because of the relationship between the heat pump refrigerant and the water in the condenser heat exchanger C, the sensor 22 can obtain an indication of the water temperature by sensing the water temperature, the refrigerant temperature or the refrigerant pressure in the condenser heat exchanger. Preferably, valve 18 should be a variable flow valve so that valve 18 adjusts water flow rate through the condenser heat exchanger C so as to maintain the temperature of the water leaving the condenser at least at the predetermined return temperature level. A wide variety of valves for this use is commercially available.

The sensor 22 may be positioned at different locations depending on what is being sensed as indicative of the water temperature. The valve 18 may likewise be relocated at different positions within the water flow circuit without departing from the scope of the invention.

It is contemplated that different arrangements may be used to control the temperature of the heated water being returned to the tank T. One such alternative arrangement is to control the output flow rate of pump 12 so that the water will be heated up to the predetermined temperature in the condenser heat exchanger C before being returned to the tank.

The heating unit 10 is provided with a thermostatic controller 25 responsive to the tank water temperature thereat falling below the preset activation temperature of the thermostatic controller to operate the compressor CP and circulation pump 12 until the tank water temperature at the controller 25 is raised back to the preset activation temperature to stop the operation of the heating unit 10. The thermostatic controller 25 is located in the vicinity of the lower end of tank T as is usual in water heaters to insure that all of the water comes up to the desired temperature before operation of the heating unit 10 is stopped.

OPERATION

Usually, the water in the tank T is heated so that the selected water temperature is maintained at the level set in the thermostatic controller 25. A typical setting is about 130° F. Because the water in tank T tends to stratify, there will usually be a temperature gradient between the upper end of tank T and the level of controller 25 so that the temperature of the water in the upper level of tank T is at a temperature of about 140° F.

When the user opens a tap for hot water, the hotter water at the upper end of tank T is drawn off while fresh cold water from the supply pipe $P_C$ enters the lower end of tank T. Because of the high degree of stratification that takes place between the colder and warmer water, the cold water remains in the lower end of tank T. As soon as this cold water level reaches the vicinity of the controller 25 so that the temperature drops below the setting of controller 25, it initiates operation of the heating unit 10.

The heat pump 11 starts supplying heated refrigerant to the condenser heat exchanger C while pump 12 pumps water from the lower end of tank T to the exchanger C. The valve 18 adjusts the flow of this water through the condenser heat exchanger C so that the water flowing back into the upper end of tank T is maintained at the set temperature of valve 18. Normally, there would be no flow from the condenser heat exchanger C back to tank T initially because it will take a short time for the water in the condenser heat exchanger to heat up to the set temperature of valve 18.

As the temperature of the water in the condenser heat exchanger C reaches the set temperature, heated water starts to flow back to the tank T. Because of the high degree of heat stratification of the water in tank T, the heated water returned to the tank from the condenser heat exchanger C remains in the upper level of tank T. Thus, the coldest water in tank T remains at its lower end to be withdrawn and circulated through the condenser heat exchanger C for heating.

Because the heating rate capacity of the heat pump 11 is usually not such that the cold water from supply pipe $P_C$ at the lower end of tank T can be heated up to the set temperature of valve 18 as fast as pump 12 can pump the water, the initial heated water flow from the condenser heat exchanger C back to the tank T will usually be well below the pumping capacity of pump 12. Because the amount of heat required to heat the water up to the set temperature of valve 18 is reduced as the temperature of the water withdrawn from tank T rises, the heated water flow rate back to tank T will increase as the temperature of the water in the lower end of tank T increases until the flow rate reaches the pumping capacity of pump 12.

The heat pump 11 continues to heat the water as it is circulated by pump 12 until the temperature of the water in the tank T at the level of the thermostatic controller 25 reaches the shutoff temperature set in the controller. This stops the operation of the heating unit 10 until the temperature of the water again drops below the set tank water temperature.

The predetermined return water temperature selected to be controlled via valve 18 is set by the minimum temperature which still allows use by the user. While this minimum useable temperature will vary from application to application, a setting of about 110°–120° F. has been found satisfactory. The use of valve 18 permits the heating rate capacity of the heat pump 11 to be practically minimized so as to reduce the cost thereof by taking advantage of the fact that hot water is normally consumed intermittently while still providing reasonable hot water temperature for use. A heat pump 11 having a heating capacity of about 12,000 BTU per hour has operated satisfactorily for typical water heaters.

Setting the predetermined return water temperature via valve 18 lower than the selected temperature to be maintained at the thermostatic controller 25 inherently causes the water in the tank T to be circulated through the condenser heat exchanger C more than once during a typical heating cycle. As the cold water is circulated through the condenser heat exchanger C for the first time, it is heated to the predetermined return water temperature (110°–120° F.) and returned to the tank T. After the temperature of the water in the tank T has been raised to the predetermined return water temperature, the pump 12 continues to operate to recirculate the water in the tank T through the condenser heat exchanger C until the temperature of the water in the tank T reaches a level such that the water temperature at controller 25 causes the controller to stop operation of heat pump 11 and circulation pump 12.

The heat transfer rate to the water in the condenser heat exchanger C is, of course, also dependent on the temperature of the medium from which heat is being withdrawn by the evaporator heat exchanger E. Where air is used as this medium as illustrated in the drawing, locating the evaporator heat exchanger E in the space where the hot water heater is typically located usually supplies air at a sufficient temperature to provide satisfactory operation of the heat pump 11.

The heating unit 10 has been disclosed as being used to heat water in the tank of a pre-existing conventional hot water heater H. It is to be understood that the inventive concept is not limited thereto since the water tank need not be part of such a conventional hot water heater. Further, the heating unit 10 and water tank T may be constructed as a single unit rather than separately as illustrated. Where the user has a pre-existing hot water heater H already installed, however, considerable cost savings are achieved by using such water heater both in equipment and installation costs. Because the installation of the heating unit 10 on an existing hot water heater is simple, the user can normally do the installation without professional help.

What is claimed as invention is:

1. A water heater construction for storing hot water at the normal predetermined tank temperature associated with hot water heaters including:

a water tank having an upper end, a lower end, and a cold water supply for supplying cold water to the lower end of said water tank;

a heat pump having condenser heat exchanger externally of said water tank;

circulation pump means for pumping water from the lower end of said water tank through the condenser heat exchanger to heat the water and back into the upper end of said water tank;

a variable flow control valve operatively connecting the condenser heat exchanger to the upper end of said water tank so that water pumped through the condenser heat exchanger is returned to the upper end of said water tank through said variable flow control valve, said variable flow control valve responsive to the temperature of the water in the condenser heat exchanger to regulate the flow of water from the condenser heat exchanger to the upper end of said water tank so that the water returned to the upper end of said water tank is at least at a predetermined return water temperature sufficient for immediate use but below the normal predetermined tank temperature; and thermostatic control means responsive to the temperature of the water at a predetermined position in said water tank and operatively connected to both said heat pump and said circulation pump means, said thermostatic control means set at the normal predetermined tank temperature to operate both said heat pump and said circulation pump means when the temperature of the water in said water tank at said predetermined position drops below the normal predetermined tank temperature until the temperature of the water at said predetermined position in said water tank is raised back to the normal predetermined tank temperature so that the water in said water tank is first circulated through said condenser heat exchanger to heat the water to said predetermined return water temperature until substantially all of the water in said water tank is at least at said predetermined return water temperature and then further circulated through said condenser heat exchanger to heat the water above said predetermined return water temperature until the water in said water tank has been heated to the normal predetermined tank temperature at said predetermined position.

2. A method of heating water in a water tank to the normal predetermined tank temperature associated with water heaters using a heat pump with a condenser heat exchanger comprising the steps of:

circulating water with a pump from the lower end of the water tank through the condenser heat exchanger when the water in the water tank drops below the normal predetermined tank temperature to heat the water to an initial return water temperature sufficient for immediate use but below the normal predetermined tank temperature and returning the thusly heated water to the upper end of the water tank until substantially all of the water in the water tank is at least at said initial return water temperature; and continuing the circulation of the water with the pump from the lower end of the water tank through the condenser heat exchanger to heat the water to a temperature higher than said initial return water temperature and returning the thusly heated water to the upper end of the water tank until the water in the water tank has been raised above said initial return water temperature back to the normal predetermined tank temperature.

3. The method of claim 2 wherein the step of circulating the water includes continuously varying the flow rate of the water through the condenser heat exchanger to the upper end of the water tank so that the water flow rate through the condenser heat exchanger increases as the temperature of the water withdrawn from the lower end of the water tank increases above that of the cold water supplied to the water tank whereby the rate of heat transfer between the heat pump and the water is maximized while the desired hot water recovery rate is maintained.

4. The method of claim 3 wherein said initial return water temperature is about 110°-120° F. and the normal predetermined tank temperature is about 130°-140° F.

5. The water heater construction of claim 1 wherein said predetermined return water temperature is about 110°-120° F. and wherein the normal predetermined tank temperature is about 130°-140° F.

6. The water heater construction of claim 5 wherein the size of said heat pump is such that the cold water withdrawn from the lower end of said water tank is heated at a rate such that the water flow through the condenser heat exchanger regulated by said flow control valve is less than the pumping capacity of said circulation pump means and the water flow rate through the condenser heat exchanger increases toward the pumping capacity of said circulation pump means as the temperature of the water withdrawn from the lower end of said water tank increases above that of the cold water supplied to said water tank whereby the rate of heat transfer between the heat pump and the water is maximized while the desired hot water recovery rate is maintained.

7. A heating unit for heating water in an existing water heater having a water tank for storing water at the normal predetermined tank temperature associated with the water heater into which cold water is introduced adjacent the lower end thereof and from which hot water is withdrawn from adjacent the upper end thereof, a drain valve communicating with the water tank adjacent the lower end thereof through a drain opening, and a pressure relief valve communicating with the upper end of the water tank through a relief port, said heating unit comprising:

a heat pump including a heat exchanger adapted to heat water while said heat pump is operating;

a circulation pump connected to said heat exchanger for forcing water through said heat exchanger;

a variable flow control valve connected to said heat exchanger for controlling the water flow through said heat exchanger and responsive to the temperature of the water in the heat exchanger to regulate the flow of water through said heat exchanger so that the heated water flowing out of said heat exchanger is at least at a predetermined initial return water temperature below the normal predetermined tank temperature;

first connection means including first fitting means removably connecting said circulation pump to the drain valve so that water from the lower end of the water tank will be supplied to said circulation pump;

a connector connecting the pressure relief valve to the relief port in the water tank;

a cutoff valve connected to said connector at the pressure relief valve; and second connection means including second fitting means removably connecting said flow control valve to said cutoff valve so that hot water forced through said heat exchanger and said flow control valve by said circulation pump is returned to the upper end of the water tank through said cutoff valve and said connector.

8. The heating unit of claim 7 further including:

thermostatic control means responsive to the temperature of the water at a predetermined position in the water tank being below the normal predetermined tank temperature to operate said heat pump and said circulation pump until the temperature of the water at the predetermined position in the water tank is raised back to the normal predetermined tank temperature so that the water in the water tank is first circulated through said heat exchanger to heat the water to said predetermined initial return water temperature until substantially all of the water in said water tank is at least at said predetermined initial return water temperature and then further circulated through said heat exchanger to heat the water above said predetermined initial return water temperature until the water in said water tank has been heated to the normal predetermined tank temperature at said predetermined position.

9. The heating unit of claim 8 wherein said predetermined tank temperature is about 130°-140° F. and wherein said predetermined initial return water temperature is about 110°-120° F.

10. The heating unit of claim 7 wherein the heating rate capacity of said heat pump is such that the cold water withdrawn from the lower end of the water tank is heated at a rate so that the water flow through said condenser heat exchanger regulated by said flow control valve is less than the pumping capacity of said circulation pump and the water flow rate through said condenser heat exchanger increases toward the pumping capacity of said circulation pump as the temperature of the water withdrawn from the lower end of the water tank increases above that of the cold water supplied to the water tank whereby the rate of heat transfer from said heat pump to the water is maximized while the desired hot water recovery rate is maintained.

* * * * *